US006691781B2

(12) United States Patent
Grant et al.

(10) Patent No.: US 6,691,781 B2
(45) Date of Patent: Feb. 17, 2004

(54) DOWNHOLE GAS/WATER SEPARATION AND RE-INJECTION

(75) Inventors: Alexander Angus Grant, Doune (GB); Per Almdahl, Oslo (NO); Per Eivind Gramme, Porsgrunn (NO); Sven Arne Kjolberg, Porsgrunn (NO); Bjarne Olsen, Lysaker (NO); Terje Sondtvedt, Lysaker (NO)

(73) Assignees: Weir Pumps Limited, Glasgow (GB); Norsk Hydro ASA, Olso (NO)

( * ) Notice: Subject to any disclaimer, the term of this patent is extended or adjusted under 35 U.S.C. 154(b) by 0 days.

(21) Appl. No.: 09/951,596

(22) Filed: Sep. 13, 2001

(65) Prior Publication Data

US 2002/0059866 A1 May 23, 2002

(30) Foreign Application Priority Data

Sep. 13, 2000 (GB) ..... 0022411

(51) Int. Cl.[7] ..... E21B 43/49

(52) U.S. Cl. ..... 166/265; 166/306; 166/105.5; 210/540; 210/802

(58) Field of Search ..... 166/265, 169, 166/306, 105.5, 369, 305.1, 372, 90.1; 210/532.1, 534, 537, 539, 540, 799, 800, 802, 805, 104, 109, 188

(56) References Cited

U.S. PATENT DOCUMENTS

| | | | | |
|---|---|---|---|---|
| 4,241,787 A | | 12/1980 | Price | 166/105 |
| 4,296,810 A | | 10/1981 | Price | 166/265 |
| 4,766,957 A | | 8/1988 | McIntyre | 166/265 |
| 5,343,945 A | | 9/1994 | Weingarten et al. | 166/105.5 |
| 5,588,486 A | * | 12/1996 | Heinrichs | 166/50 |
| 5,794,697 A | | 8/1998 | Wolflick et al. | 166/265 |
| 5,860,476 A | | 1/1999 | Kjos | 166/265 |
| 6,035,934 A | | 3/2000 | Stevenson et al. | 166/265 |
| 6,056,054 A | * | 5/2000 | Brady et al. | 166/265 |
| 6,082,452 A | * | 7/2000 | Shaw et al. | 166/105.5 |
| 6,189,614 B1 | * | 2/2001 | Brady et al. | 166/266 |
| 6,283,204 B1 | * | 9/2001 | Brady et al. | 166/105.5 |
| 6,457,522 B1 | * | 10/2002 | Bangash et al. | 273/120 R |
| 2001/0017207 A1 | * | 8/2001 | Haheim | 166/265 |
| 2002/0153326 A1 | * | 10/2002 | Oddie | 210/747 |

FOREIGN PATENT DOCUMENTS

| | | |
|---|---|---|
| EP | 1041243 A2 | 10/2000 |
| GB | 2302892 A | 2/1997 |
| GB | 2326895 A | 1/1999 |
| GB | 2332463 A | 6/1999 |
| WO | WO 97/33070 | 9/1997 |
| WO | WO 98/41304 | 9/1998 |
| WO | WO 00/77343 A1 | 12/2000 |

* cited by examiner

*Primary Examiner*—David Bagnell
*Assistant Examiner*—Daniel P Stephenson
(74) *Attorney, Agent, or Firm*—Gifford, Krass, Groh, Sprinkle, Anderson & Citkowski, P.C.

(57) ABSTRACT

It is common in oil extraction operations to reinject produced gas and\or water back into hydrocarbon bearing formations in order to maintain formation pressure. Conventional production facilities normally flow all formation fluids to the surface and subsequently reinject the required fluids back into the formation, which can be extremely inefficient due to the high power input required to overcome the large pressure differential between the surface and formation level.

A production fluid handling method and apparatus for separating downhole at least gaseous and liquid components (16, 18, 20) of fluid produced from a hydrocarbon bearing formation (12), and reinjecting at least a portion of the gaseous and liquid components (16, 18, 20), as required, back into the formation (12). Re-injection also occurs downhole.

49 Claims, 9 Drawing Sheets

DOWNHOLE GAS/WATER SEPARATION AND RE-INJECTION

FIELD OF THE INVENTION

The present invention relates to a method of downhole separation of produced gas or produced gas and water from produced oil, and re-injection of the gas, or water, or gas and water. The invention also relates to apparatus for use in implementing the method.

BACKGROUND OF THE INVENTION

In oil and gas production from downhole or earth formations, the produced fluid is extracted via a drilled bore which extends from the surface to intercept the hydrocarbon-bearing formation. In many applications the formation is characterised by the presence of a gas cap which maintains the pressure in the formation, the formation thus being described as gas driven. Effectively the gas drive forces the hydrocarbon liquids and formation water into the well bore and hence to the surface. This is a particular but not exclusive characteristic of condensate-producing formations. Such formations are also often characterised by the presence of fractures or fissures, this resulting in tracking of gas with the reservoir liquids into the well bore and hence production of large volumes of gas with these liquids. Production of these high gas volumes to the surface is often undesirable, firstly because there may be no suitable system for transport to market and the option of flaring is now considered to be environmentally objectionable, and secondly because it is preferable to retain the gas in the formation to maintain formation pressure. In many cases it is also preferred that the produced water be retained in the formation.

Accordingly, many oil production facilities will: flow the formation liquids and gas to the surface; separate the different components; compress the gas; and then inject the gas, and when required the produced water, under pressure, back down into the formation. The gas and water may be transported from surface to the formation either via a separate flow path in the production bore or down another well bore. However, this is inefficient, as a high power input is required to generate the necessary elevated pressures: typically, the pressure of the produced fluids at the reservoir might be 250 bar and at the surface 15 bar, thus necessitating a surface compressor differential of 235 bar.

It is among the objectives of the present invention to obviate or mitigate this and other disadvantages.

SUMMARY OF THE INVENTION

According to a first aspect of the present invention there is provided a production fluid handling method comprising the steps:

separating downhole at least gaseous and liquid components of fluid produced from an underground formation; and at least one of (I) injecting at least a proportion of the gas back into the formation, and (ii) producing at least a proportion of the gas to the surface.

The production or produced fluids in an oil well typically comprise oil and water, or oil, water and gas.

Preferably, the method further comprises separation of the liquid components of the produced fluid, that is the oil and water. At least a proportion of the water may be re-injected back into the formation, or produced to surface.

Alternatives for production, separation and re-injection of produced fluids are summarised in the following table:

| Bottom Hole fluids | Re-injected Fluids | Separation Stages |
|---|---|---|
| 1. Oil + Water | Water | 1 Stage. Water from Oil |
| 2. Oil + Water + Gas | Water | 2 Stages. Gas from Liquids. Water from Oil. |
| 3. Oil + Water + Gas | Gas | 1 Stage. Gas from Liquids |
| 4. Oil + Water + Gas | Water + Gas | 2 Stage. Gas from Liquids. Water from Oil. |

Aspects of the present invention may be utilised in the second, third and fourth alternatives.

Preferably, the separation of the components of the produced fluid takes place at or about the same depth as the formation.

Separation of the components of the produced fluid may be achieved by cyclonic separation or other known separation method, however it is preferred to use a horizontal gravity separation process. Such a separation process for oil and water only is described in Norsk Hydro International Patent Application WO98\41304, the disclosure of which is incorporated herein by reference. The process involves passing the produced fluid through a substantially horizontal pipe under conditions, principally related to flow velocity, which allow the different components of the fluid to stratify.

The Norsk Hydro apparatus relates particularly to the production alternative 1 of the above table. All of the other three alternatives require separation of the gas. It has been found that the gas separation can be readily achieved by using a modified form of such an apparatus. The gas separation process may be used on its own if only gas is to be separated from the liquids. Alternatively, if liquid separation is also required, that is if all three fluid components, oil, gas, and water, are to be separated, the gas separation apparatus may be used in combination with the apparatus as described in WO98\41304; that is, a gas\liquid separator may be used in combination with an oil\water separator.

It has been found that sloping downwards of the gas\liquid separator in the direction of flow by a small angle, typically between 1 and 10 degrees, is extremely beneficial in suppressing wave formation, which has a tendency to increase the number of oil droplets in the separated gas. In the absence of wave formation the flow rate through the separator may be significantly increased: it has been found that, for a particular produced fluid, even a 1° inclination of the separator allowed the flow rate to be at least doubled.

Preferably, once the gas component is separated from the liquid component, the separated gas may be collected by means of an elongate tube positioned in the gas\liquid separator and longitudinally aligned with the direction of flow. Collecting the gas in this manner prevents re-mingling of the gas and liquid after separation since the gas is enclosed within the elongate tube.

Conveniently, the upstream end of the elongate tube is tapered from the tube upper surface to the tube lower surface. Additionally, an array of holes is provided in the upper surface of the elongate tube to allow collection of gas which has passed over the elongate tube. Preferably, the lower surface of the elongate tube gas collector defines a substantially planar surface.

Preferably also, the separated oil and water may be collected by means of respective elongate tubes located within the oil\water separator and longitudinally aligned with the direction of flow. Preferably, the oil collector is positioned in an upper portion of the oil\water separator and is substantially identical in form to the gas collector.

Conveniently, the water collector is positioned in a lower portion of the oil\water separator. Preferably the upstream end of the water collector is tapered from the tube lower surface to the tube upper surface. Preferably also, the lower surface of the water collector comprises an array of holes to collect water which has passed between the water collector and the separator. Preferably, the upper surface of the elongate tube water collector defines a substantially planar surface aligned with the gas\liquid interface.

It is desirable that the separated gas which is to be re-injected be virtually free of oil droplets, as many crude oils precipitate solid asphaltene and paraffinic compounds when produced, and these precipitates can cause formation damage that is extremely difficult to remove. Further, formation of such precipitates could, through time, seriously impair injection flow rates. In the preferred embodiments of the invention, the presence of liquid droplets would also have an erosive effect on compressor rotor and stator blades, and for this reason also droplet presence should be minimised.

Oil droplet presence can also be further reduced by incorporating a droplet separator downstream of the gas\liquid separator, this droplet separator discharging the so separated liquid into the separated liquid stream from the gas\liquid separator. Such a separator may be, for example, either a cyclone or a centrifuge or a static or spinning swirl generator.

Preferably, when it is desirable to re-inject the gas, it is compressed downhole at or around the formation or reservoir depth. Thus, the differential pressure required is only that to overcome the relatively small difference in the static pressure and the injectivity resistance of the reservoir. This pressure difference will be typically 10 bar to 30 bar; the benefits in power performance when compared with compression at the surface, as described previously, will be apparent to those skilled in the art. Thus, the produced gas and, where appropriate, the produced water, may be injected by means of a compressor, or a pump, or a combination of both, directly back into the formation.

The ratios of gas, water and oil present in the produced fluid are likely to change as the formation characteristics vary with time, and thus it is desirable for the separation and re-injection processes and equipment to have the flexibility to accommodate such variation.

It is also desirable to provide control over the quantity of fluids which are produced to the surface and injected into the formation, to accommodate for changes in formation characteristics. Such control may be provided by the use of at least one level monitor located in the downhole separator, said at least one level monitor being utilised to indicate the fluid component levels and initiate signals to adjust flow control valves which may be located at surface level accordingly. The flow control valves may alternatively be located downhole. Preferably, at least one level monitor is located in the gas\liquid separator and at least one level monitor is located in the oil\water separator, when an oil\water separator is provided.

As noted above, it is preferred to compress the produced gas downhole when re-injection is required. Proposals for downhole compressors for boosting depleting gas wells are described in Shell International Patent Application WO97\33070 and Weir Pumps Ltd UK Patent Application 0013449, the former describing an oil-filled motor driven multi-stage gas compressor and the latter a gas filled motor driven multistage gas compressor. Potentially, either of these proposals could be utilised in the present application, however it is preferred that compression of the gas is achieved using a multi-stage axial flow turbine directly coupled to, that is on a single shaft with, a multi-stage axial flow compressor, although other turbine or compressor forms may also be utilised. The preferred compressor is capable of running at high speed, typically in the range 15,000 to 40,000 rpm, to generate the required gas pressures. This avoids the difficulties inherent in, for example, oil-filled motors which cannot run at these speeds, as losses associated with friction and churning are intolerable. Further, although a gas filled motor can be run at high speed, and be directly coupled to the compressor on a single shaft, there would be difficulties associated with high bottom hole pressures and installing the compressor set in what is essentially an oil producing well. However, an axial flow turbine, in the preferred turbine driven compressor solution, may be powered by any suitable liquid delivered under pressure from a surface installed charge pump. In a preferred embodiment the liquid is produced liquid and co-mingles at discharge from the turbine with the produced liquid discharged from the downhole separator. It is advantageous if static heads from surface to the compressor are similar on the flow paths for power liquid from the surface and produced liquid to the surface.

Most preferably, the compressor is arranged such that its discharge end and the turbine exhaust are adjacent to one another. By so arranging, the compressor generated pressure may drive a small amount of compressed gas across a shaft labyrinth seal into the turbine exhaust, which is preferred to having liquid leakage in the opposite direction.

Preferably, the turbine bearings are lubricated by the power liquid and the compressor bearings are lubricated by compressed gas from the compressor discharge, following removal of all residual solids or liquid droplets by a final filtration device which might typically be a cyclone, the residual solids or liquid droplets preferably being returned to either the compressor discharge flow or the compressor inlet.

Further aspects of the present invention also relate to apparatus utilised to implement the methods as described above.

BRIEF DESCRIPTION OF THE DRAWINGS

These and other aspects of the present invention will now be described, by way of example, with reference to the accompanying drawings, in which.

DETAILED DESCRIPTION OF THE DRAWINGS

Figure 1:
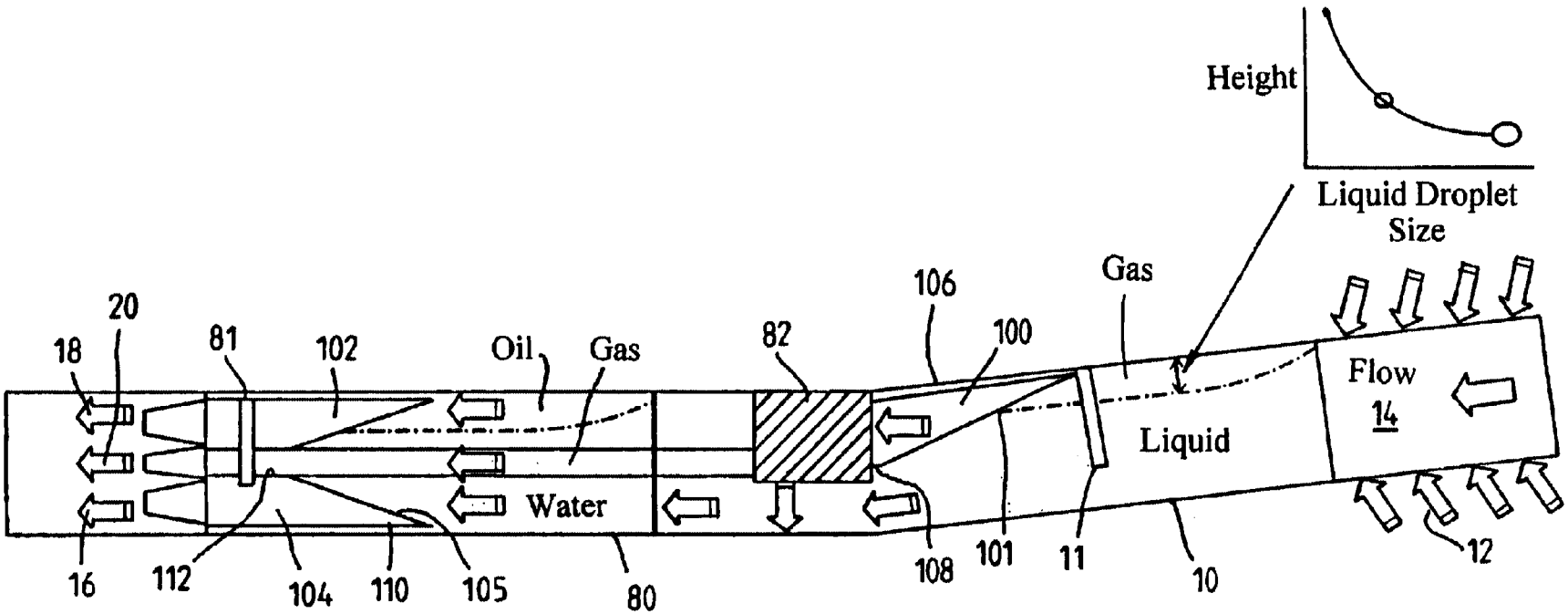
FIG. 1 is a schematic illustration of a three phase fluid separator for use in a method in accordance with a preferred embodiment of the present invention.

Reference is first made to FIG. 1 of the drawings, which is a schematic illustration of a three phase fluid gravity separator which consists of a first stage gas\liquid separation stage 10 in combination with a second stage oil\water separation stage 80, the latter being similar to that described in WO98\41304. Both separation stages rely on gravity. The first stage separator 10 is an adaptation of the separators as described in WO98\41304, and serves to separate gas from the liquid in the production fluid flowing from the reservoir 12. Primarily, a gas\liquid separator may be significantly shorter, typically around 20 meters long, than a oil\water separator, which is typically around 100 meters long. The separator 10 slopes downward in the direction of flow 14 by a small angle of several degrees, as this has been found to suppress wave formation, which has a tendency to increase the number of liquid droplets in the separated gas. As will be described below, the separated gas 20 will either be re-mingled with the produced oil 18 and produced to the surface while the separated water 16 is re-injected into the reservoir 12, or the separated gas 20 will be subsequently compressed and re-injected either separately or in combination with the produced water 16 in the reservoir 12 while the produced oil 18 is flowed to the surface. After separation, the water component 16 will either flow with the separated oil 18 to the surface, be re-injected with the gas component 20, or be re-injected separately of the gas component. Residual liquid droplets in the separated gas 20 are removed by an intermediate separator 82 and discharged into the liquid flow stream from the first stage separator 10. This intermediate separator 82 is an enhanced gravity type utilising a screen cyclone or centrifuge or static or spinning swirl generator.

The gas\liquid separator 10 and the oil\water separator 80 each comprise a level monitor 11, 81 which are utilised to initiate signals to adjust flow control valves (not shown) positioned at surface level in order to control the quantity of fluids flowing to and flowing from the surface. The function of the level monitors 11, 81 will be described in more detail below.

Also shown in FIG. 1 are three collectors 100, 102, 104 for respectively collecting separated gas, oil and water. The gas collector 100 is located in the gas\liquid separator 10 and consists of an elongated tube longitudinally aligned with the direction of flow 14. The upstream end 101 of the gas collector 100 is tapered from the tube upper surface 106 to the tube lower surface 108 and the lower surface 108 defines a substantially planar surface. Additionally, the upper surface 106 of the gas collector 100 comprises an array of holes (not shown) to allow collection of gas which has passed over the gas collector 100.

The oil and water collectors 102, 104 are positioned in the oil\water separator 80 and are similar in form to the gas collector 100 with the exception that the upstream end 105 of the water collector 104 is tapered from the lower surface 110 to the upper surface 112, and the upper surface 112 defines a planar surface. Additionally, the lower surface 110 of the water collector 104 defines a number of holes (not shown) to collect water which has passed between the water collector 104 and the inner surface of the oil\water separator 80.

Figure 2:
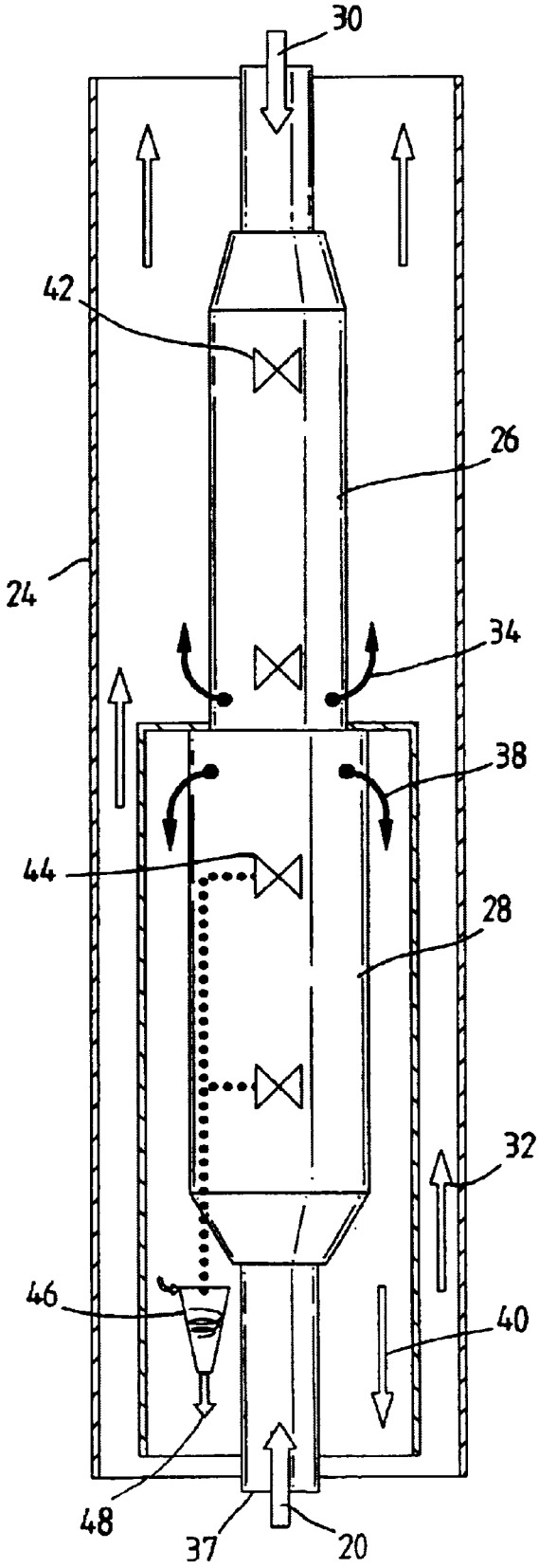
FIG. 2 is a schematic illustration of a turbine driven compressor for use in a method in accordance with a preferred embodiment of the present invention.

FIG. 2 is a schematic of a downhole turbine driven multi-stage axial flow gas compressor 24, as is preferred for use in the present invention. The turbine 26 is a multi-stage axial flow turbine directly coupled to the compressor 28 by a single shaft. The turbine 26 is driven by a power liquid 30 which is delivered under pressure from a surface installed charge pump; the power liquid utilised to drive the turbine is produced oil 32, or in other embodiments may be produced liquid comprising water and oil. The power liquid is exhausted at the compressor end 34 where it mixes with the produced liquid 32 and is flowed to the surface with the produced liquid 32.

The compressor 28 is arranged such that the separated gas 20 enters the compressor inlet 37 and is discharged at the end 38 adjacent to the turbine exhaust 34. This arrangement prevents condensate leakage from the turbine exhaust 34 into the compressor discharge 38 as the compressor generated pressure will drive a small amount of compressed gas across an appropriate shaft labyrinth seal into the turbine exhaust 34. As will be described, the compressed gas 40 is re-injected back into the formation 12.

The turbine bearings 42 are lubricated by the power liquid 30 and the compressor bearings 44 are lubricated by compressed gas 40 from the compressor discharge 38 after all residual liquid droplets or solids have been removed by a cyclone 46. The residual solids or liquid droplets 48 removed by the cyclone are returned to either the compressor discharge gas flow 40 or the compressor inlet 37.

Figure 3:
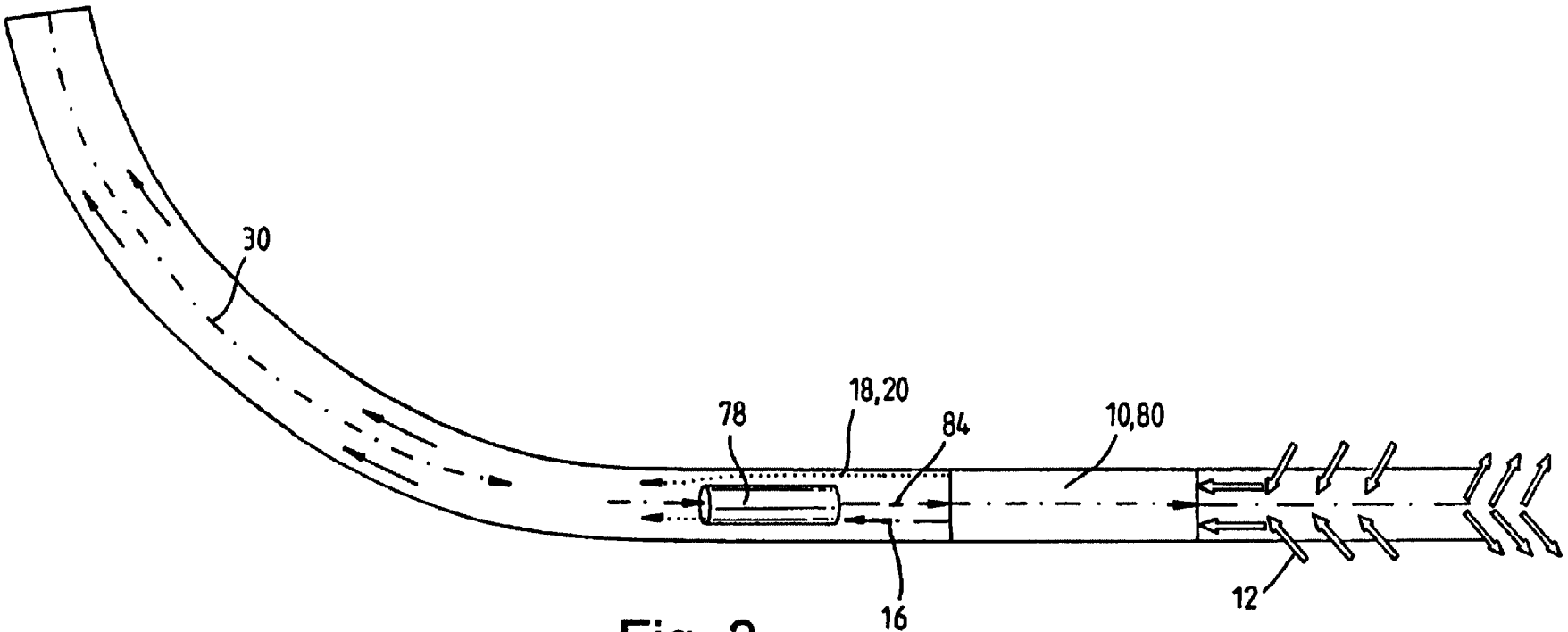
FIG. 3 illustrates a downhole 3 phase fluid separation system in accordance with the first embodiment of the present invention in which the gas and oil are re-mingled and produced to the surface and the water is re-injected.

FIG. 3 is a schematic illustration of a downhole three phase, gas\liquid\oil, separation system in accordance with a first embodiment of the present invention. The formation liquids and gas pass from the production zone 12 through the two stage separator 10, 80, following which the separated gas 20 is re-mingled with the separated oil 18 and the gas and oil flow together to the surface. The separated water 16 is passed to a turbine driven pump 78 from which it is re-injected 84 back into the formation 12. The turbine which drives the pump 78 for water re-injection is itself driven by a power liquid 30 which is delivered under pressure from the surface. The produced oil 18 and gas 20 from the separator 10, 80 are mixed with the exhausted power liquid 30 and the mixture is flowed to the surface.

To accommodate for changes in the formation characteristics, a level signal from the level monitor 11 (FIG. 1) positioned in the gas/liquid separator 10 is used to adjust a flow control valve (not shown), located at surface level, which valve controls the total quantity of fluids being produced to the surface from the formation 12. Additionally, a signal from the level monitor 81 (FIG. 1) positioned in the oil/water separator 80 is used to control the downhole water injection pump speed, and hence the re-injected water flowrate, by means of a further flow control valve (not shown) at surface level which controls the quantity of power liquid 30 delivered to the pump 78 turbine drive.

Figure 4:
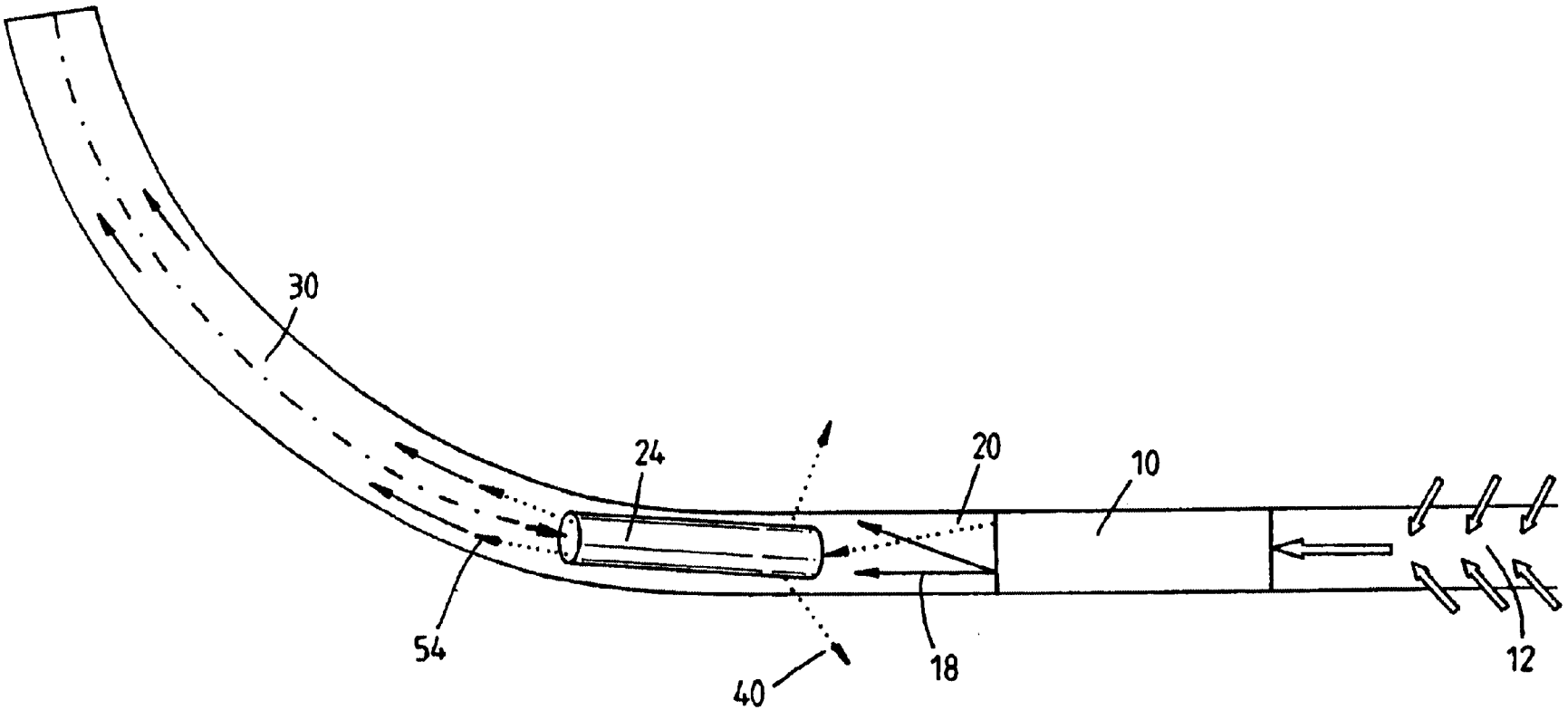
FIG. 4 illustrates a downhole gas separation and re-injection system in accordance with a second embodiment of the present invention in which the oil and water are produced to the surface and the gas is re-injected.

FIG. 4 is a schematic illustration of a downhole gas separation and re-injection system in accordance with a second embodiment of the present invention. The formation liquids and gas pass from the production zone 12 through the gas\liquid separator 10. The separated gas 20 has residual liquid droplets removed in the liquid droplet separator 82 (FIG. 1) and is passed on to the turbine driven compressor 24 where it is compressed and the compressed gas then re-injected 40 back into the formation 12. The turbine 26 which drives the compressor for gas re-injection is itself driven by a power liquid 30 which is delivered under pressure from the surface. The produced liquid 18 from the separator 10 is mixed with the exhausted power liquid 54 and the mixture is flowed to the surface.

Figure 5:
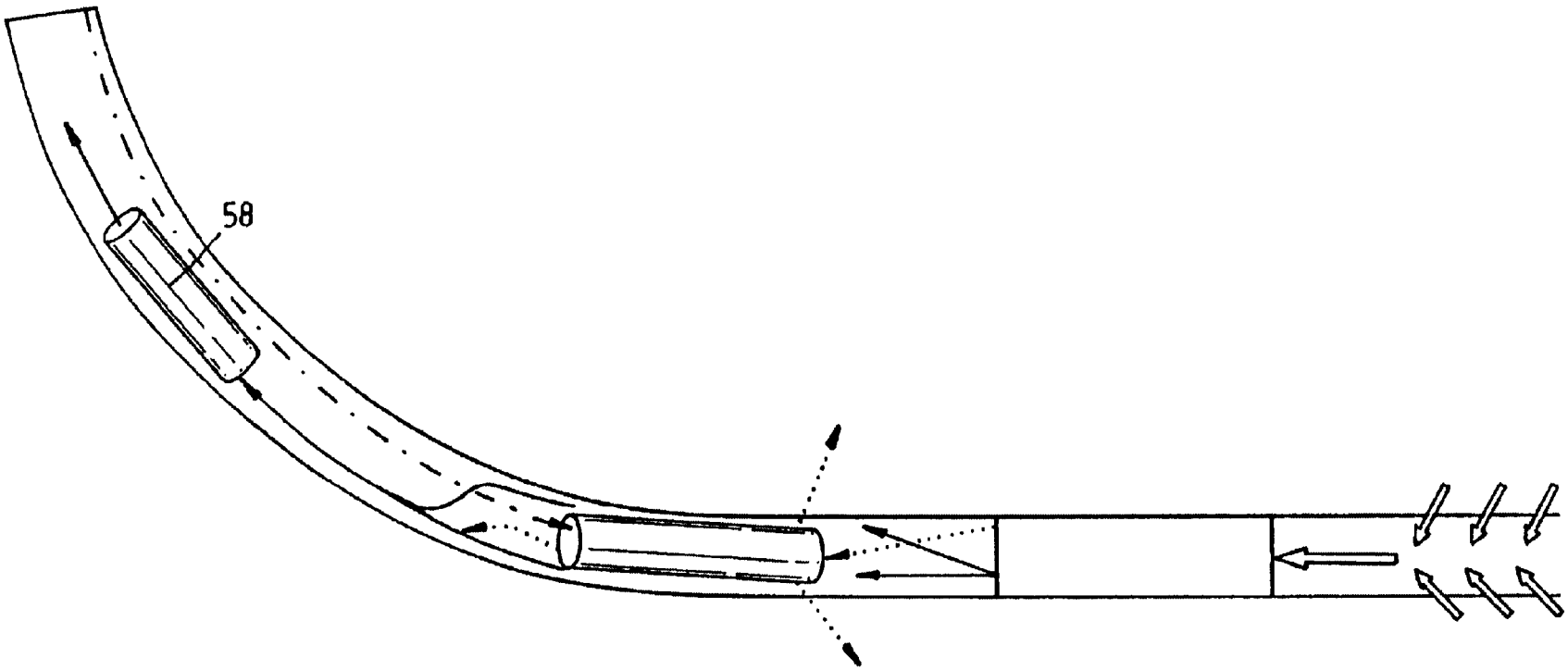
FIG. 5 illustrates a downhole gas separation and re-injection system in accordance with a third embodiment of the present invention in which the oil and water are produced to the surface and the gas is re-injected, and utilising an artificial lift unit.

FIG. 5 illustrates a system similar to that of FIG. 4 but with the inclusion of artificial lift arrangement 58 for facilitating the flow of liquids to the surface. The artificial lift arrangement may take the form of a conventional lift arrangement, such as an electric submersible pump (ESP), a hydraulic turbine pump drive, or a gas lift.

In the embodiments shown in FIGS. 4 and 5, flow control is effected by a signal from the level monitor 11 (FIG. 1) positioned in the gas\liquid separator, which signal is utilised to control the speed of the downhole compressor 28, and hence the reinjected gas flowrate, by means of a control valve (not shown) at the surface which controls the quantity of power liquids 30 delivered from the surface to the turbine driven compressor 24.

Figure 6:
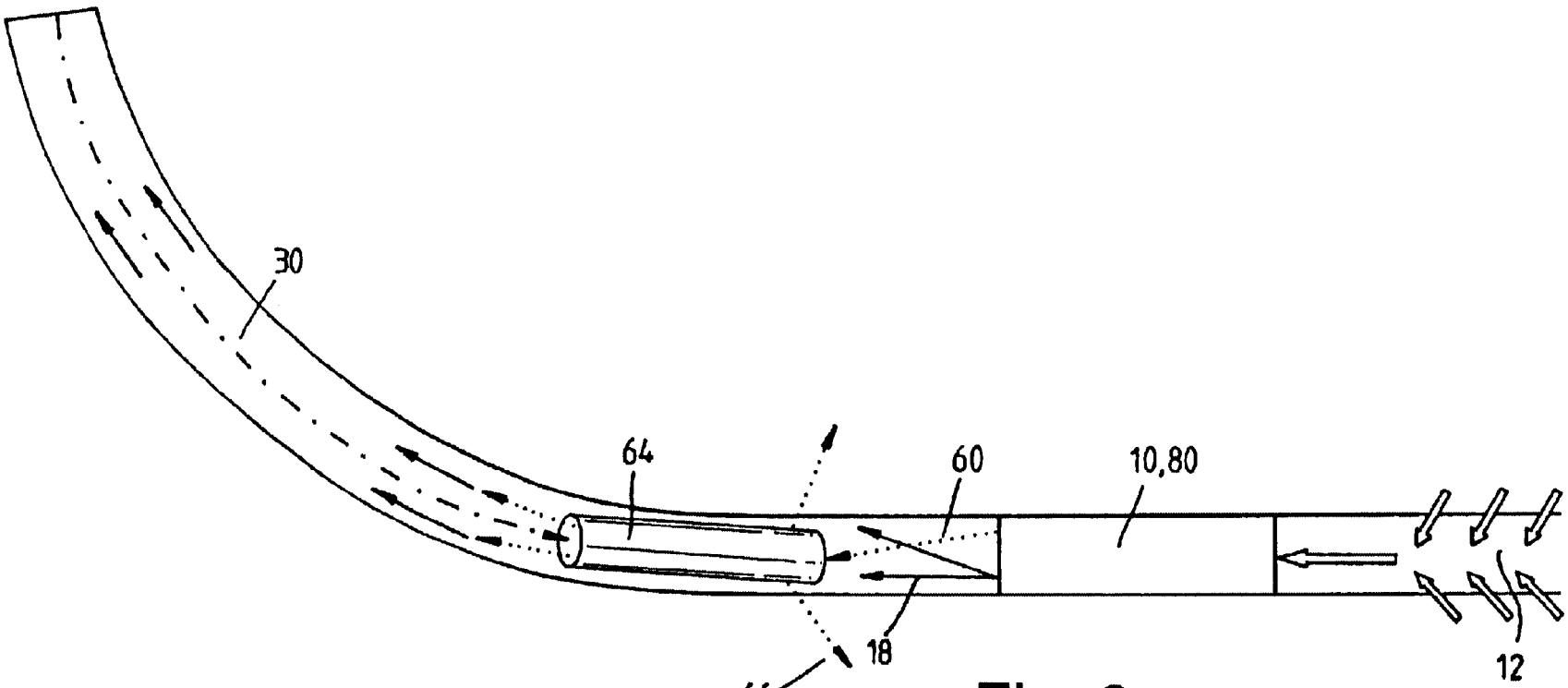
FIG. 6 illustrates a downhole three phase fluid separation system in accordance with a fourth embodiment of the present invention in which the gas and water are re-infected together.

Reference is now made to FIG. 6 of the drawings, which illustrates a two stage, three phase downhole gas\water\oil separation and re-injection system in accordance with a fourth aspect of the present invention. The illustrated system is similar to that of FIG. 4, however the system of FIG. 6 enables the re-injection of both separated gas and water 60. The formation liquids and gas pass from the formation 12 through the separator 10, 80 where the gas, water and oil are separated. The produced oil 18 is flowed to the surface and the separated gas and water 60 are pressurised by a turbine driven multi-phase pump 64, the turbine being driven by a power liquid 30 delivered from the surface. The gas and water are then re-injected 66 back into the production zone 12. The power liquid from the exhaust of the turbine is mixed with the produced oil and the mixture is flowed to the surface.

Figure 7:
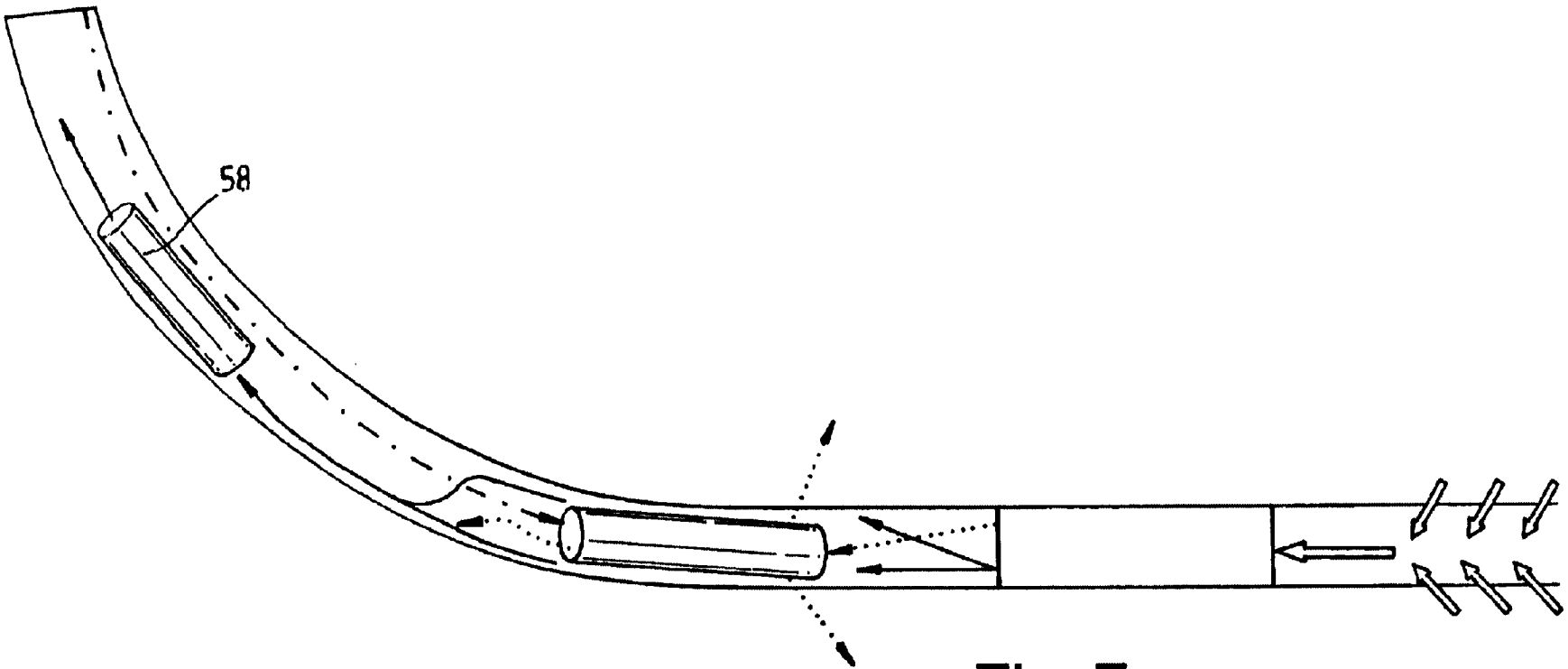
FIG. 7 illustrates a downhole three phase fluid separation system in accordance with a fifth embodiment of the present invention in which the gas and water are re-injected together and in which an artificial lift unit is utilised to boost the produced oil to surface.

FIG. 7 illustrates a system similar to the system of FIG. 6, with the addition of an artificial lift unit 58.

In order to control the flow of fluid to the surface, a signal from the level monitor 11 (FIG. 1) in the gas\liquid separator 10 is used to adjust a control valve (not shown) positioned at surface level which controls the quantity of oil being produced from the formation 12. In a similar fashion, a signal from the level monitor 81 (FIG. 1) in the oil\water separator is used to control the speed of the multiphase pump 64, and hence the re-injected water\gas flowrate, by means of a control valve (not shown) at surface level which controls the quantity of power liquid 30 delivered to the multiphase injection pump 64.

Figure 8:
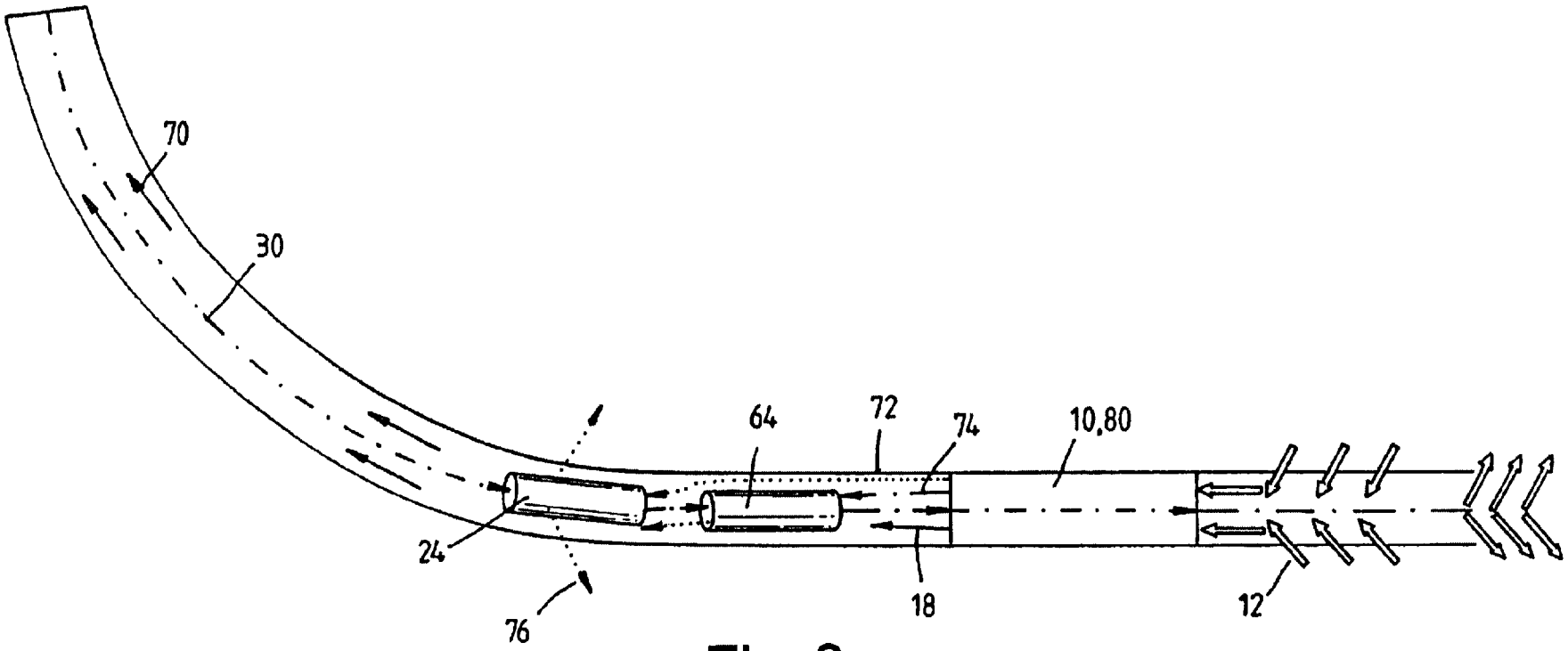
FIG. 8 illustrates a downhole three phase fluid separation system in accordance with a sixth embodiment of the present invention, in which the gas and water are re-injected separately.
Figure 9:
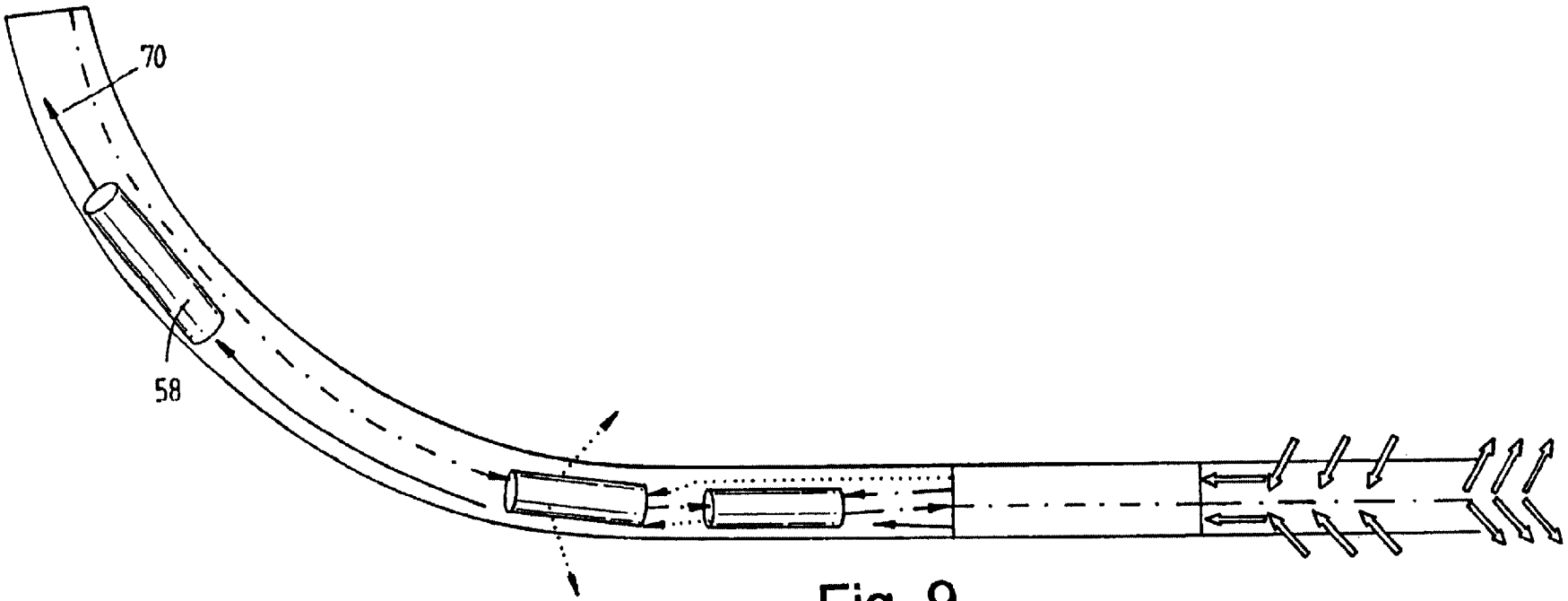
FIG. 9 illustrates a downhole three phase separation system in accordance with a seventh embodiment of the present invention, in which the gas and water are re-injected separately and in which an artificial lift unit is utilised to boost the oil to the surface.

FIGS. 8 and 9 illustrate downhole gas and water separation and re-injection systems where the separated gas and water 72, 74 from the separator 10, 80 are re-injected separately. The separated gas 72 is compressed by a turbine driven compressor 24 and re-injected 76 back into the formation 12. The separated water is pressurised by a turbine driven pump 64. As with the above described embodiments, the turbines in both the compressor and pump are driven by the same power liquid 30 pumped into and down the well bore from the surface.

The oil produced 18 from the formation 12 via the separator 10 is mixed with the exhaust fluid from the turbine used to drive the multi-phase pump and this mixture is then flowed to the surface or, as illustrated in FIG. 9, an artificial lift unit 58 is employed to deliver the mixture 70 to the surface.

In the embodiments shown in FIGS. 8 and 9, a signal from the level monitor 11 (FIG. 1) in the gas\liquid separator 10 is used to adjust the speed of the downhole turbine driven gas compressor 24, and hence the re-injected gas flowrate, by means of a control valve (not shown) located at surface level which controls the quantity of power fluid 30 delivered to the compressor turbine drive 26. Additionally, a signal from the level monitor 81 (FIG. 1) in the oil\water separator 80 is used to control the speed of the turbine driven pump 64, and hence the re-injected water flow rate, by means of a control valve (not shown), located at surface level, which controls the quantity of power fluid 30 delivered to the turbine driven pump 64 turbine drive.

It will be apparent to those of skill in the art that the above described embodiments of the present invention are merely exemplary, and that various modifications and improvements may be made thereto without departing from the scope of the present invention.

We claim:

1. A production fluid handling method comprising the steps:

separating downhole at least gaseous and liquid components of fluid produced from an underground formation by horizontal gravity separation;

injecting at least a proportion of the separated gaseous component back into the formation;

compressing gas downhole using a compressor driven by a turbine; and powering the turbine by power liquid delivered under pressure from surface.

2. The method of claim 1, further comprising compressing gas downhole at or around formation or reservoir depth using a multi-stage axial flow compressor driven by a multi-stage axial flow turbine.

3. The method of claim 2, further comprising directly coupling the multistage axial flow turbine to the multistage axial flow compressor.

4. The method of claim 1, further comprising separating the liquid component of the produced fluid to obtain oil and water.

5. The method of claim 4, further comprising re-injecting at least a proportion of the liquid component back into the formation.

6. The method of claim 4, wherein at least a proportion of the liquid component is produced to surface.

7. The method of claim 1, wherein the produced fluid comprises oil, water and gas, and the method comprises the steps of:

separating the gas from the oil and water;

separating the water from the oil; and re-injecting at least a proportion of the water back into the formation.

8. The method of claim 1, wherein the produced fluid comprises oil, water and gas, and the method comprises the steps of:

separating the gas from the oil and water; and re-injecting at least a proportion of the gas back into the formation.

9. The method of claim 1, wherein the produced fluid comprises oil, water and gas, and the method comprises the steps of:

separating the gas from the oil and water;

separating the water from the oil; and re-injecting at least a proportion of the gas and the water back into the formation.

10. The method of claim 1, comprising separating the components of the produced fluid at or about the same depth as the formation.

11. The method of claim 1, further comprising:

providing a gas\liquid separator;

providing an elongate tube in the gas\liquid separator and longitudinally aligning the tube with a direction of flow of the produced fluid; and collecting the separated gas component in the tube.

12. The method of claim 1, further comprising:

providing an oil\water separator;

providing an elongate tube in an upper part of the oil\water separator and longitudinally aligning the tube with a direction of flow of the produced fluid;

separating the oil and water components; and collecting the separated oil component in the tube.

13. The method of claim 1, further comprising:

providing an oil\water separator;

providing an elongate tube in a lower part of the oil\water separator and longitudinally aligning the tube with a direction of flow of the produced fluid;

separating the oil and water components; and collecting the separated water component in the tube.

14. The method of claim 1, further comprising compressing and then re-injecting the gaseous component.

15. The method of claim 14, further comprising compressing the gaseous component downhole at or around formation or reservoir depth.

16. The method of claim 1, further comprising re-injecting the fluid component by means of a downhole pump.

17. The method of claim 16, further comprising driving the pump by a downhole fluid driven turbine.

18. The method of claim 16, further comprising locating the downhole pump at or around formation or reservoir depth.

19. The method of claim 1, further comprising controlling the relative proportions of fluids produced to the surface and fluids injected into the formation to accommodate changes in formation characteristics.

20. The method of claim 19, further comprising providing at least one level monitor in a downhole separator, and utilising said at least one level monitor to indicate the fluid component levels and initiate signals to adjust surface flow control valves accordingly.

21. The method of claim 19, comprising providing said at least one level monitor in a gas\liquid separator.

22. The method of claim 19, comprising providing at least one level monitor in a gas/liquid separator and at least one level monitor in an oil/water separator.

23. A production fluid handling method comprising the steps:

providing a horizontal gravity gas\liquid separator and sloping downwards the gas\liquid separator in a direction of flow of fluid produced from an underground formation;

separating downhole at least gaseous and liquid components of the produced fluid by horizontal gravity separation; and at least one of (i) injecting at least a proportion of the separated gaseous component back into the formation, and (ii) producing at least a proportion of the gaseous component to the surface.

24. The method of claim 23, comprising sloping downwards the gas\liquid separator in the direction of flow of the produced fluid by an angle of between 1 and 10 degrees.

25. The method of claim 24, comprising sloping downwards the gas\liquid separator in the direction of flow of the produced fluid by around 1 degree.

26. The method of claim 23, further comprising passing the gaseous component through a droplet separator downstream of the gas\liquid separator.

27. A production fluid handling method comprising the steps:

separating downhole at least gaseous and liquid components of fluid produced from an underground formation by horizontal gravity separation;

injecting at least a proportion of the separated gaseous component back into the formation;

compressing gas downhole at or around formation or reservoir depth using a multi-stage axial flow compressor driven by a multi-stage axial flow turbine; and powering the turbine by power liquid delivered under pressure from surface.

28. The method of claim 27, wherein the power liquid is produced fluid and co-mingles at discharge from the turbine with the liquid component discharged from a downhole separator.

29. The method of claim 28, wherein static heads from surface to the compressor are similar on flow paths for power liquid from the surface and produced liquid to the surface.

30. The method of claim 27, comprising arranging the compressor such that a discharge end thereof and the turbine exhaust are adjacent to one another.

31. The method of claim further comprising lubricating a plurality of turbine bearings with the power liquid and lubricating the compressor bearings with compressed gas from the compressor discharge.

32. Apparatus for production fluid handling, the apparatus comprising:

a downhole horizontal fluid separator for separating at least gaseous and liquid components of fluid produced from an underground formation, a downhole gas compressor for injecting at least a portion of the gaseous component back into the formation; and a separated gas collector comprising an elongate tube positioned in the gas/liquid separator, wherein an upstream end of the elongate tube gas collector is tapered from a tube upper surf ace to a tube lower surface.

33. An apparatus as defined in claim 32, wherein the horizontal fluid separator further comprises an oil/water separator.

34. An apparatus as defined in claim 33, further comprising a separated oil collector in the form of an elongate tube positioned in an upper portion of the oil/water separator.

35. An apparatus as defined in claim 34, wherein an array of holes is provided in an upper surface of the elongate tube oil collector to allow collection of oil.

36. An apparatus as defined in claim 33, further comprising a separated water collector in the form of an elongate tube positioned in a lower portion of the oil/water separator.

37. An apparatus as defined in claim 36, wherein an upstream end of the elongate tube water collector is tapered from a tube lower surface to a tube upper surface.

38. An apparatus as defined in claim 32, further comprising a separated gas collector comprising an elongate tube positioned in the gas/liquid separator.

39. An apparatus as defined in claim 32, herein an array of holes is provided in an upper surface of the elongate tube gas collector to allow collection of gas.

40. An apparatus as defined in claim 36, wherein the downhole gas compressor is driven by a hydraulic turbine.

41. An apparatus as defined in claim 40, wherein the downhole gas compressor is a multistage axial flow compressor driven by a multistage axial flow turbine.

42. An apparatus as defined in claim 40, wherein the turbine is directly coupled to the compressor.

43. An apparatus as defined in claim 40, wherein the turbine is powered by a liquid delivered under pressure from surface.

44. An apparatus as defined in claim 40, wherein the turbine includes a plurality of bearings adapted to be lubricated by the power liquid and the compressor includes a plurality of bearings adapted to be lubricated by compressed gas from the compressor discharge.

45. Apparatus for production fluid handling, the apparatus comprising:

a downhole horizontal fluid separator for separating at least gaseous and liquid components of fluid produced from an underground formation;

a downhole gas compressor for injecting at least a portion of the gaseous component back into the formation; and a separated gas collector comprising an elongate tube positioned in the gas/liquid separator, wherein a lower surface of the elongate tube gas collector is substantially planar.

46. Apparatus for production fluid handling, the apparatus comprising:

a downhole horizontal fluid separator for separating at least gaseous and liquid components of fluid produced from an underground formation;

a downhole gas compressor for injecting at least a portion of the gaseous component back into the formation; and a separated gas collector comprising an elongate tube positioned in the gas/liquid separator, wherein an upstream end of the elongate tube oil collector is tapered from a tube upper surface to a tube lower surface.

47. Apparatus for production fluid handling, the apparatus comprising:

a downhole horizontal fluid separator for separating at least gaseous and liquid components of fluid produced from an underground formation;

a downhole gas compressor for injecting at least a portion of the gaseous component back into the formation;

a separated gas collector comprising an elongate tube positioned in the gas/liquid separator; and a separated oil collector in the form of an elongate tube positioned in an upper portion of the oil/water separator, wherein a lower surface of the elongate tube oil collector is substantially planar.

48. Apparatus for production fluid handling, the apparatus comprising:

a downhole horizontal fluid separator for separating at least gaseous and liquid components of fluid produced from an underground formation;

a downhole gas compressor for injecting at least a portion of the gaseous component back into the formation; and a separated water collector in the form of an elongate tube positioned in a lower portion of the oil/water separator, wherein the horizontal fluid separator further comprises an oil/water separator, and an array of holes is provided in a lower surface of the elongate tube water collector to allow collection of water.

49. Apparatus for production fluid handling, the apparatus comprising:

a downhole horizontal fluid separator for separating at least gaseous and liquid components of fluid produced from an underground formation;

a downhole gas compressor for injecting at least a portion of the gaseous component back into the formation; and a separated water collector in the form of an elongate tube positioned in a lower portion of the oil/water separator, wherein the horizontal fluid separator further comprises an oil/water separator, and a lower surface of the elongate tube water collector is substantially planar.

* * * * *